United States Patent [19]

Själander

[11] 4,106,394

[45] Aug. 15, 1978

[54] METHOD OF FORMING A WRAPPING FOR A SHIPMENT UNIT AND DEVICE FOR CARRYING OUT THE METHOD

[76] Inventor: Theodor Själander, Nipstadsgatan 11, 881 00 Solleftea, Sweden

[21] Appl. No.: 767,840

[22] Filed: Feb. 11, 1977

[30] Foreign Application Priority Data

Feb. 12, 1976 [SE] Sweden ..... 7601601

[51] Int. Cl.[2] ..... B31D 5/00; B31B 17/00

[52] U.S. Cl. ..... 93/1 F; 93/35 SB; 93/55.1 R; 156/70; 156/443

[58] Field of Search ..... 156/70, 227, 443; 93/1 F, 35 SB, 55.1 R, 55.1 P; 229/88; 206/321

[56] References Cited

U.S. PATENT DOCUMENTS 2,704,179 3/1955 Wilcox ..... 93/55.1 P X

*Primary Examiner*—Travis S. McGehee

*Attorney, Agent, or Firm*—Birch, Stewart, Kolasch & Birch

[57] ABSTRACT

A method and apparatus are provided for fabricating a hooded thermoplastic shipping wrapper for enveloping three sides and the ends of elongated packages of lumber and the like. A table is provided for supporting the center piece of the wrapper, forming a welded trough or pocket and drawing cord in one end, forming the center piece into an inverted U-shaped cross section and welding an end plate to the periphery of the cross section to provide a hood shape to the finished wrapper. The table is either winged to go from a flat to a U-shape or is tapered to permit one end of the center piece to assume a U-shape for receiving the welded end plate.

17 Claims, 5 Drawing Figures

METHOD OF FORMING A WRAPPING FOR A SHIPMENT UNIT AND DEVICE FOR CARRYING OUT THE METHOD

BACKGROUND AND SUMMARY OF THE INVENTION

The present invention relates to a method of forming a wrapping for a shipment unit of lumber or similar material, the wrapping comprising a center portion which is of the same length as the unit and encloses the latter on three sides, and having at least one fixed end-piece.

Wrappings of this type have hitherto been formed by manual labor in a number of work operations, the parts of the wrapping being assembled by gluing, which complicates and adds to the cost of the forming process.

It is the object of the present invention to afford a quick and inexpensive method of forming a wrapping of the type described above, which object is achieved if the method and the device are endowed with the characteristics set out in the following claims.

Other objects and further scope of applicability of the present invention will become apparent from the detailed description given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
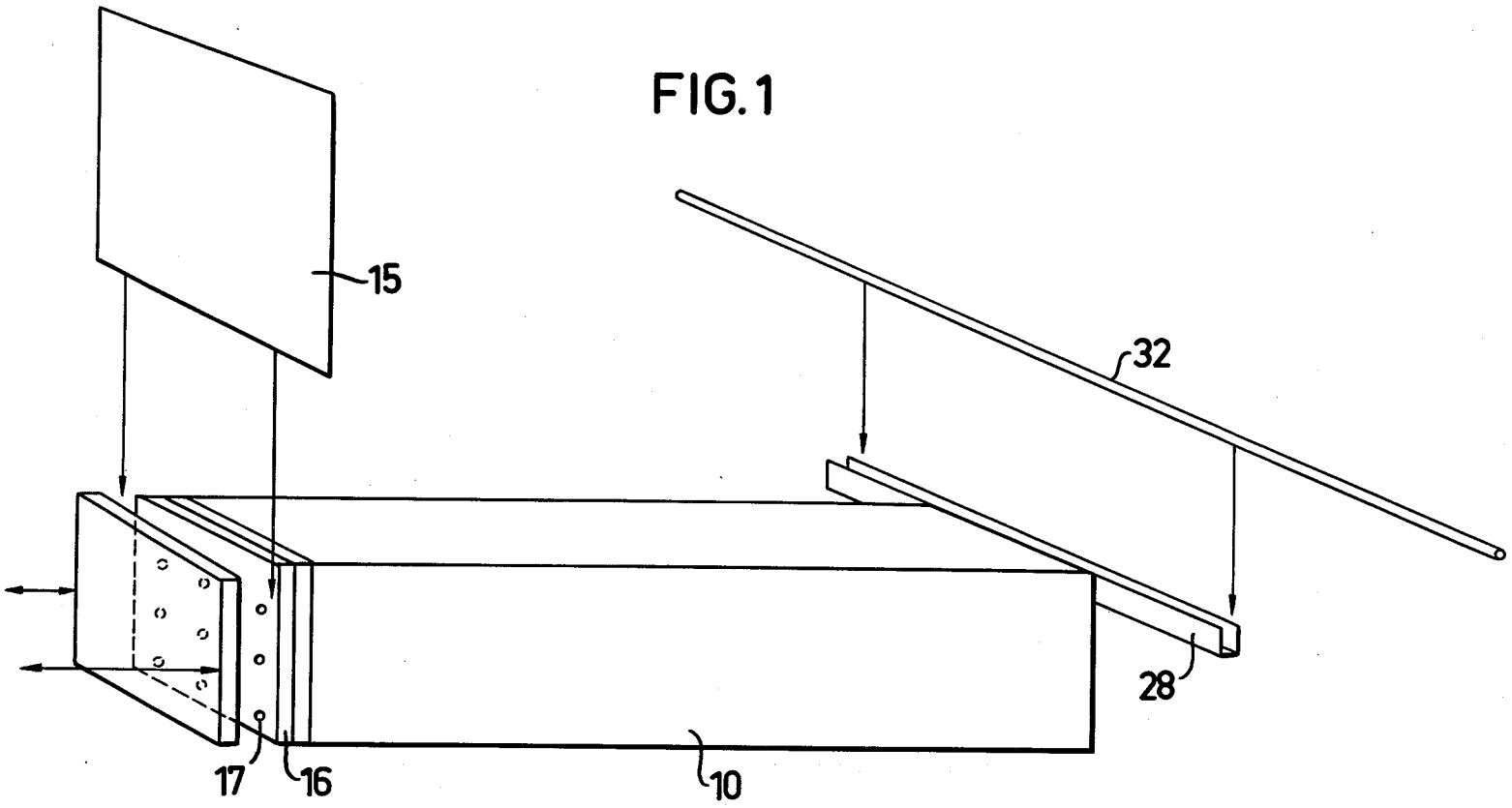
FIG. 1 is a perspective view of an example of a forming table for carrying out the method of the invention for forming a wrapping.

The wrapping formed in the embodiment illustrated in the drawings is intended to be used for packaging shipment units of lumber. The wrapping takes the shape of an elongated hood of square or rectangular cross section formed of suitable wrapping material such as plastic or the like, and intended to be placed over the stack of lumber. The hood is of pre-determined dimensions, and one end of it is preferably transparent to allow the reading of markings etc. on the lumber, which is most simply achieved by joining on a separate end-piece of a transparent material. At the other end, which need not be transparent, the hood can be drawn together over the end of the unit stack by means of a drawing cord. Therefore, it is normally not necessary to attach a separate end-piece but only to weld said drawing cord in place. However, it must be made clear that although it is described below in connection with a wrapping of the type described, the invention is not limited thereto, but may be applied to wrappings of other forms, e.g. having separate end-pieces at both ends, or other conceivable designs.

Figure 2:
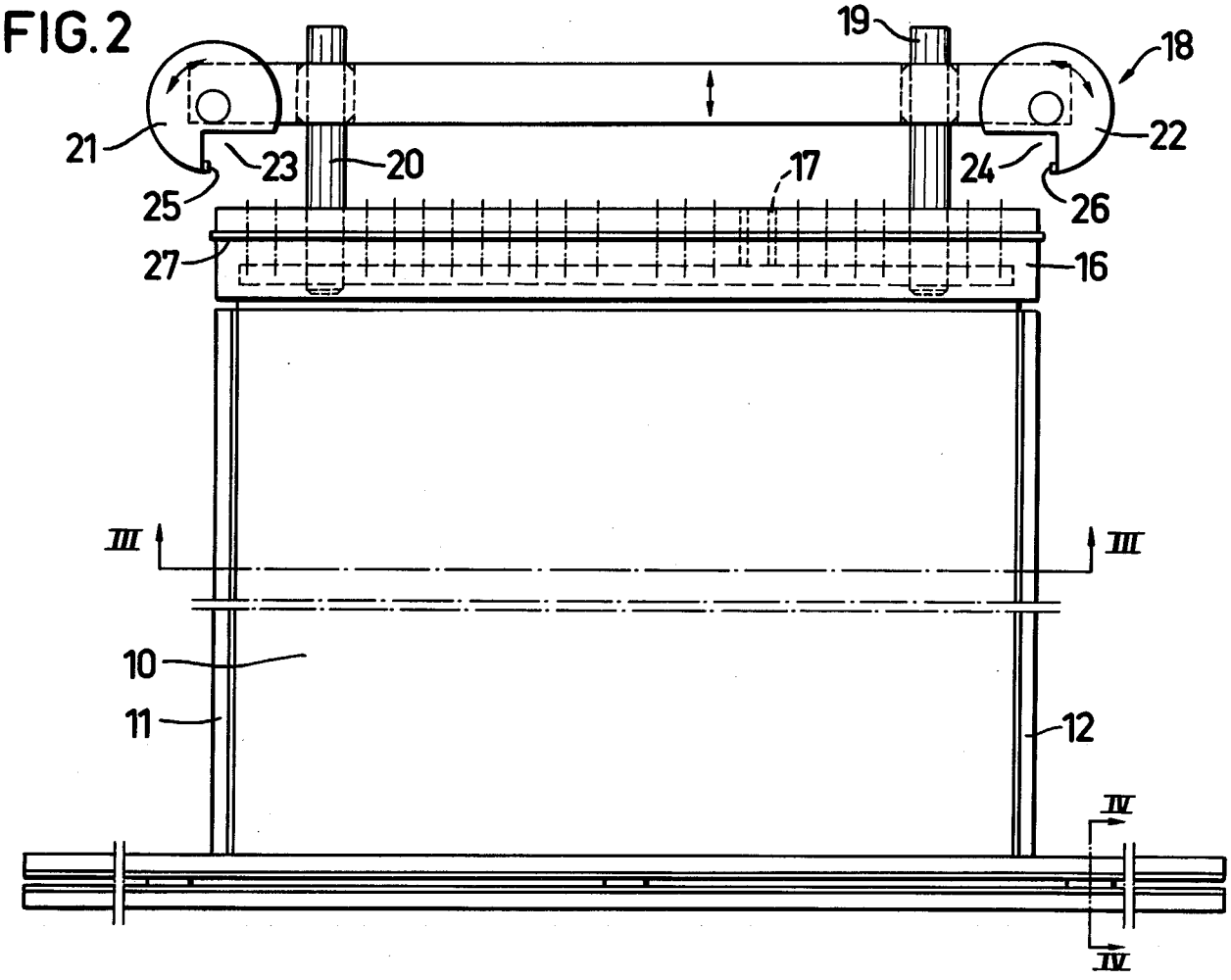
FIG. 2 is a plan view of the forward end of the forming table.
Figure 3:
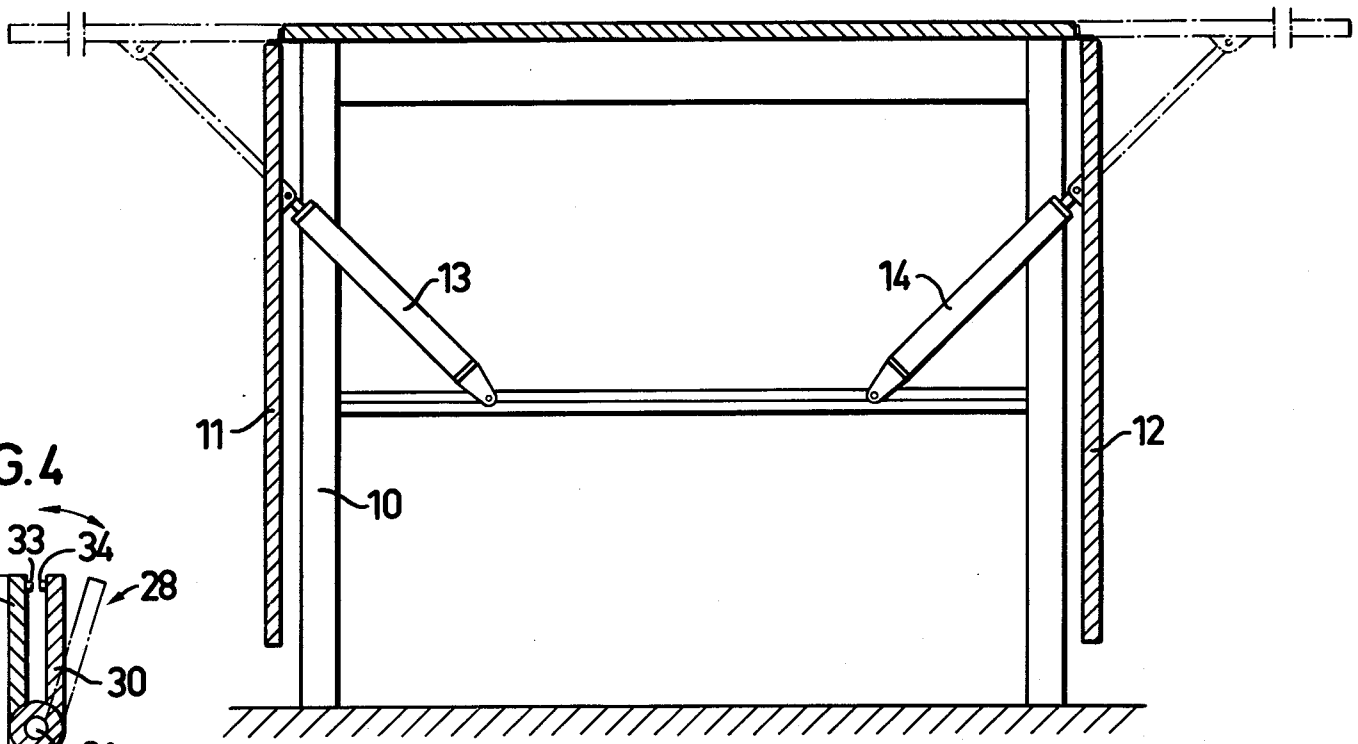
FIG. 3 shows a section on line III—III in FIG. 2.

In the embodiment presented, as appears from FIGS. 1 to 3 of the drawings, the device comprises a forming table 10 whose height and width dimensions correspond approximately to those of the shipment unit for which the wrapping is to be used, while its length is equal to that of the unit plus an overlapping portion of the wrapping to be used for covering one end of the shipment unit by drawing the wrapping together with the aid of the cord described.

Positioned along the sides of the table are folding flaps 11, 12, which in their raised position, shown by the dash dotted lines, form an extension of the width of the table when the wrapping is spread out on the table. The flaps are controlled by means of two cylinders 13, 14 operated by a pressure medium, e.g. compressed air or the like. When the flaps are lowered, the wrapping material supported on the table 10 is formed into a hood having the shape of an inverted U.

The end face of the table 10 consists of a vacuum plate 16 provided with openings 17 which communicate with devices of known type, not shown, for producing a vacuum in the openings 17 in order to hold the preferably transparent end-piece 15 (FIG. 1) against the end face of the table while the wrapping is being formed. The end-piece 15 is dimensioned to overlap the sides and top of the table 10 and of the wrapping center-piece supported thereon. The overlapping edges of the end-piece are used to join it to the center-piece. In order to fold the edges of the end-piece 15 over the table and join them to the main or center portion of the wrapping, a frame 18 is provided which reciprocates on guides 19, 20 with respect to the end face of the table. At the three sides of the end-piece which overlap the edge of the table, the frame 18 supports three folding and joining elements of which two — 21, 22 — are shown in FIG. 2. The folding and joining elements 21, 22, are free to rotate about central axles, are circular in shape, and are provided with notches 23, 24 in the shape of sectors encompassing about ninety degrees of their circumference at the sides of the joining elements facing the edges of the table 10. Mounted on the folding elements 21, 22 and on the forming table 10 are weld formers 25, 26, and 27, which may consist of resistive wires or bars. The joining elements 21, 22 are held by spring devices or the like (not shown) in a position, as shown in FIG. 2, such that as the frame 18 moves towards the table, the edge of the notches 23, 24, on which the weld formers 25, 26 are mounted can pass in over the sides of the table 10, forming a small angle with said sides. In this way the overlapping edge of the end-piece is folded in over the center-piece of the wrapping supported on the table 10. When the other edge of the notches 23, 24 meets the end of the table 10, the joining elements 21, 22 pivot about their respective centers and the weld formers 25, 26 are pressed against the weld former 27 mounted on the table 10, with the two plastic films between the weld formers. Thus, when the weld formers 25–27 are supplied with current (from a source which is not shown), the folded-in edge of the end piece 15 will be welded to the part of the wrapping supported on the table 10 in the same operation as the folding takes place.

Figure 4:
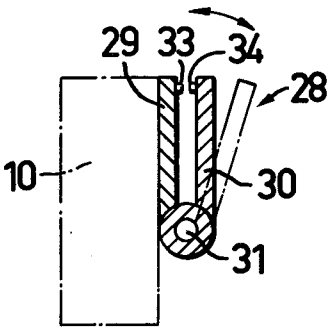
FIG. 4 shows a cross section, on line IV—IV in FIG. 2, of a device for attaching a drawing cord.

Mounted at the other end of the forming table is a transverse V-section rail 28 (FIGS. 1 and 4) of length exceeding the width of the table and at least equal to the width ot the wrapping material before it is folded, i.e. the aggregate dimension of the sides and width of the forming table 10. One member 29 of the V is in a suitable manner attached to the forming table 10, its upper edge being flush with the upper edge of the forming table, while the other member 30 is rotatably attached to the first member 29 by means of a hinge 31 or the like at the vertex of the V. The rear member 30 may be pivoted towards and away from the first member 29 by means of suitable control devices (not shown), as indicated by the arrow in FIG. 4. When the rear member 30 of the V-section rail 28 is lowered to the position indicated by dash dotted lines by means of the control device (not shown) — such as a pneumatic cylinder or the like — the rear part of the wrapping is free to fall into the channel thus opened, forming a pocket in which the drawing tape or cord 32 (FIG. 1) is placed.

In the next operation, the rear member 30 of the rail 28 is raised and the two parts of the plastic film which form the said pocket are pressed together and welded in the manner described above by two weld formers 33, 34 on the members 29, 30 of the V.

Figure 5:
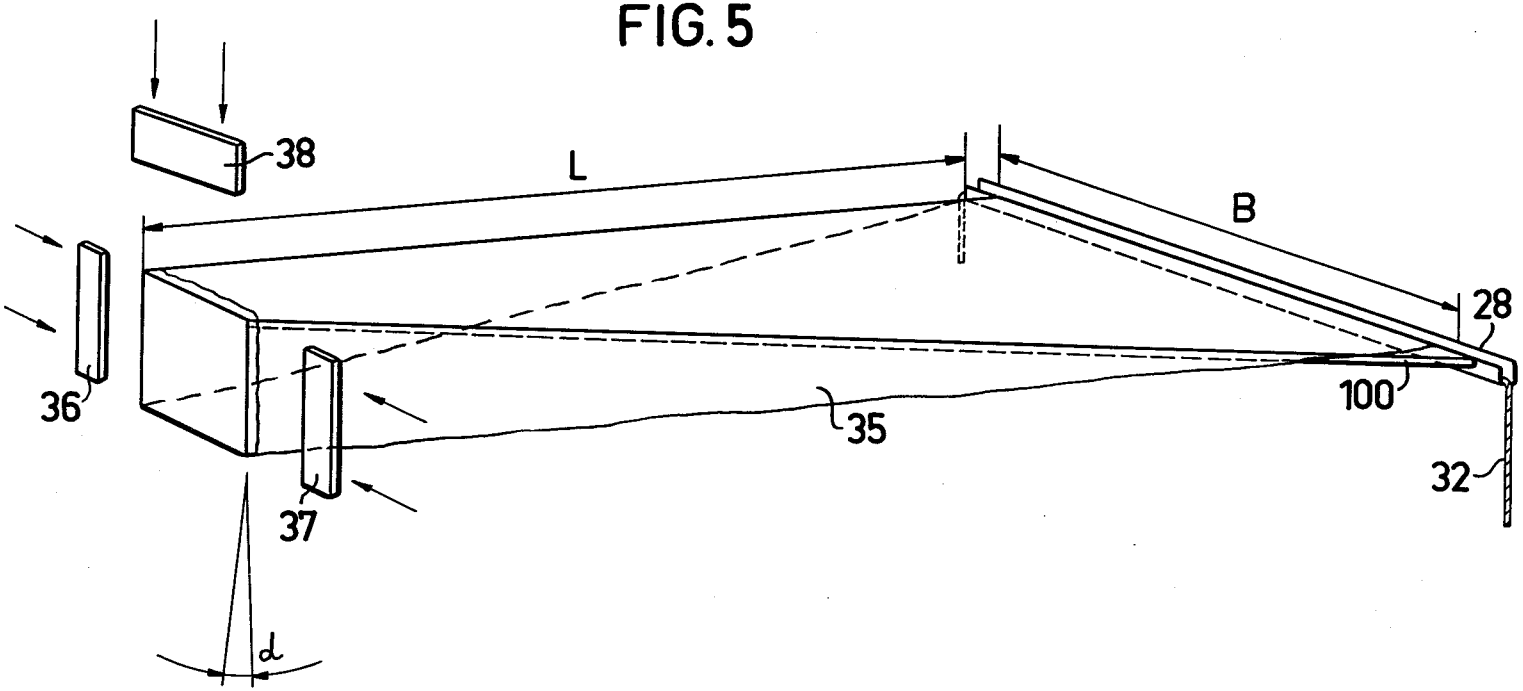
FIG. 5 shows a perspective view of another embodiment of a forming table for carrying out the method of the invention.

FIG. 5 shows in a view similar to FIG. 1 another embodiment of the forming table, whereby the parts of this embodiment common with those in FIG. 1 have received the same reference numerals. Thus, the device comprises a table 100 the end face of which consists of a vacuum plate (not illustrated) for holding the transparent end-piece 15 against the end face of the table. The end-piece overlaps the sides and top of the end face of the table 100 and, thus, the main part 35 of the wrapping. The welding formers 36, 37 and 38 shown schematically are used for welding together the end-piece 15 and the main or center piece 35. The formers 36-38 will thereby be moved against the end face of the table in the direction of the arrows in FIG. 5. Contrary to the embodiment of FIG. 1 there are no folding flaps but the table 100 consists of one single plate which widens conically towards the rear or right end of the table in FIG. 5. At the rear end of the table is the transverse V-section rail 28 for holding a cord 32 which possibly is attached to the end of wrapping opposite the end-piece 15.

In the embodiment of FIG. 5 the main part 35 of the wrapping is placed on the table plate 100 and folded downwards at the front or left end in FIG. 5 whereas the main part of the wrapping lies outspread at the rear or right end of FIG. 5. After welding the end-piece 15 to the main part 35 the wrapping is removed from the table 100 and the side parts of the main or center part of the wrapping 35 are folded down to form the ultimate wrapping. When the wrapping is removed from the table and the side parts are folded down there will be a slight displacement of the lower part of the end piece 15 to the left as seen in FIG. 5. To compensate for this displacement the end face of the table 100 is slightly inclined inwardly at the lower end with an angle $\alpha$ the size of which is adjusted with respect to the length L and width B of the table plate 100. The end face may be permanently made with an angle for one size of wrapping or the end face may be swingably mounted for adjustment to different sizes of wrapping and thus different values of the angle $\alpha$.

It is apparent from the above that the method and the device of the invention afford a quick and simple way of forming a wrapping or cover of plastic film, especially if the wrapping has the shape of a hood. It is further apparent that the embodiment shown is only one example of a realization of the invention, and that it can be varied within the terms of the invention. For example, parts of the table 10 can if necessary be provided with holding means, e.g. of vacuum type, to hold down the part of the wrapping which is supported on the table. It is also apparent that the table 10 can be provided with means for varying its dimensions, e.g. height, width, and length, if this is necessary in order to form wrappings of different dimensions on the same machine. In this case, the vacuum plate 16 is also designed to be removed and replaced with another on the guides 19, 20.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

I claim:

1. The method of forming a wrapping for a substantially rectangular block unit of material to be shipped in which said wrapping comprises a center piece which is the same length as the said unit and encloses the said unit on three sides thereof and having at least one fixed end-piece at one end comprising the steps of:

folding at least one end of said center piece into a U-shaped configuration;

placing a rectilinear end piece over said U-shaped one end and overlapping three edges with the respective closed sides of said configuration and with a fourth side of said end piece substantially in the plane of the open side of said configuration;

joining said three overlapped edges while holding said end piece in position adjacent said one end of said center piece; and placing a drawing cord transversely of said other end of said center piece and joining same.

2. The method of claim 1 which further includes the steps of forming a transverse pocket in said other end to receive said drawing cord;

receiving said drawing cord in said pocket; and closing and sealing said pocket to join said drawing cord to said center piece.

3. The method of claim 1 wherein the wrapper is formed of thermoplastic material and said sealing is performed by welding.

4. The method of claim 2 wherein the wrapper is formed of thermoplastic material and said sealing is performed by welding.

5. Forming means for fabricating a wrapper for a substantially elongated unit of material to be shipped, said unit having side surfaces and opposed end surfaces, said wrapper comprising an elongated center piece of U-shaped cross section at least as long as said unit, enclosing the majority of the side surfaces of said unit and at least one end piece engaging one end of said unit and attached to one end of said center piece in the provision of a hooded shape to said wrapper, comprising:

a forming table drawing a supporting surface for said center piece and an end plate transversely positioned with respect to said supporting surface and having a width substantially equal to that of the closed side of said cross section;

vacuum means acting through said end plate for holding an end piece of a wrapper to be assembled in immediate proximity to one of said supporting surface and a wrapper center piece supported thereon; and folding and joining frame means mounted adjacent said end plate, substantially coextensive with the periphery of said one end of said U-shaped cross section and said end piece of said wrapper, for folding the peripheral edge of said end piece over said one end of said cross section of said wrapper and joining said folded edge to said center piece;

said frame means being movable toward and away from said end plate and engaging and releasing said peripheral edge in response to the said toward and away movements, respectively.

6. The apparatus of claim 5, in which the wrapper to be formed thereby includes a drawing cord in the other end of said center piece, further comprising:

trough defining a means transversely mounted on the far end of said supporting surface remote from said end plate including an edge piece hinged to open to define a said trough to receive the said other end of the center piece and a drawing cord and to close to envelop and join said drawing cord with said center piece.

7. The apparatus of claim 6, wherein said trough defining means compries a fixed edge plate substantially coincident with the said far end of said supporting surface and a pivoted edge plate hinged to said fixed edge plate to open outwardly and downwardly to receive said other end of said center piece and form a pocket therein for receiving said drawing cord and pivots upwardly into juxtaposition with said fixed edge plate to fold said center piece to envelop and join the latter with said drawing cord.

8. The apparatus of claim 7, wherein said trough defining means further includes weld forming elements mounted on said fixed and pivoted edge plates and in registry when said plates are in closed position to weld shut said pocket in said center piece and join said drawing cord therewith.

9. The apparatus of claim 5, wherein said supporting surface further includes first and second coterminous side plates having a cumulative width with said supporting surface equal to that of said center piece and of said trough defining means; and means for pivotally mounting said side plates on said supporting surface to raise and lower the former between substantially coplanar and dependent positions with respect to the latter.

10. The apparatus of claim 9, wherein the wrapper to be formed thereby includes a drawing cord in the other end of said center piece, further comprising:

trough defining a means transversely mounted on the far end of said supporting surface remote from said end plate including an edge piece hinged to open to define a said trough to receive the said other end of the center piece and a drawing cord and to close to envelop and join said drawing cord with said center piece.

11. The apparatus of claim 10, wherein said trough defining means comprises a fixed edge plate substantially coincident with the said far end of said supporting surface and pivoted edge plate hinged to said fixed edge plate to open outwardly and downwardly to receive said other end of said center piece and form a pocket therein for receiving said drawing cord and pivots upwardly into juxtaposition with said fixed edge plate to fold said center piece to envelop and join the latter with said drawing cord.

12. The apparatus of claim 11, wherein said trough defining means further includes weld forming elements mounted on said fixed and pivoted edge plates and in registry when said plates are in closed position to weld shut said pocket in said center piece and join said drawing cord therewith.

13. The apparatus of claim 5, wherein said supporting surface is tapered from a width substantially equal to that of the said closed side of said cross section adjacent said folding frame means to a width substantially equal to that of the entire peripheral dimension of said cross section at said trough defining means.

14. The apparatus of claim 6, wherein said supporting surface is tapered from a width substantially equal to that of the said closed side of said cross section adjacent said folding frame means to a width substantially equal to that of the entire peripheral dimension of said cross section at said trough defining means.

15. The apparatus of claim 7, wherein said supporting surface is tapered from a width substantially equal to that of the said closed side of said cross section adjacent said folding frame means to a width substantially equal to that of the entire peripheral dimension of said cross section at said trough defining means.

16. The apparatus of claim 8, wherein said supporting surface is tapered from a width substantially equal to that of the said closed side of said cross section adjacent said folding frame means to a width substantially equal to that of the entire peripheral dimension of said cross section at said trough defining means.

17. The apparatus of claim 13, wherein said end plate is inclined with respect to a transverse plane perpendicular to said supporting surface in a direction to extend beneath the latter.

* * * * *